US007047986B2

(12) United States Patent
Ertle et al.

(10) Patent No.: US 7,047,986 B2
(45) Date of Patent: May 23, 2006

(54) MOVEMENT REVERSAL DEVICE, PARTICULARLY FOR A DISHWASHER

(75) Inventors: Roland Ertle, Lauingen (DE); Claus Köther, Niederstotzingen (DE); Michael Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/873,386

(22) Filed: Jun. 21, 2004

(65) Prior Publication Data

US 2004/0226586 A1 Nov. 18, 2004

Related U.S. Application Data

(63) Continuation of application No. PCT/EP02/13254, filed on Nov. 25, 2002.

(30) Foreign Application Priority Data

Dec. 21, 2001 (DE) ..... 101 63 184

(51) Int. Cl.
*B08B 3/02* (2006.01)

(52) U.S. Cl. ..... 134/56 D; 134/176; 134/179; 134/200

(58) Field of Classification Search ..... 134/176, 134/179, 198, 200, 57 D, 56 D, 58 D
See application file for complete search history.

(56) References Cited

U.S. PATENT DOCUMENTS 2,154,559 A * 4/1939 Bilde ..... 134/97.1
2,358,377 A * 9/1944 Bilde ..... 239/98
2,711,641 A * 6/1955 Groff ..... 68/184
3,160,164 A * 12/1964 Constance et al. ..... 134/176
3,361,361 A * 1/1968 Schutte ..... 239/227
3,771,725 A * 11/1973 Jenkins et al. ..... 239/243
4,175,575 A * 11/1979 Cushing ..... 134/176
4,884,585 A * 12/1989 Oh ..... 134/176
5,331,986 A * 7/1994 Lim et al. ..... 134/88
5,477,874 A * 12/1995 Yura et al. ..... 134/176
5,655,556 A * 8/1997 Guerrera et al. ..... 134/176
5,673,714 A * 10/1997 Campagnolo et al. .... 134/57 D
5,950,576 A 9/1999 Busato et al.
5,964,232 A * 10/1999 Chung ..... 134/176
6,263,888 B1 * 7/2001 Nomura et al. ..... 134/57 D (Continued)

FOREIGN PATENT DOCUMENTS

DE 1 628 518 4/1971

(Continued)

*Primary Examiner*—Frankie L. Stinson
(74) *Attorney, Agent, or Firm*—John W. Winburn; Russell W. Warnock; Craig J. Loest

(57) ABSTRACT

A movement reversal device is used in a dishwasher. The dishwasher has a washing receptacle and a hydraulic assembly provided with at least two spraying devices impinging upon goods to be washed with a fluid transported via a circulating pump. The transported fluid flows through the movement reversal device that contains at least two outlets for feeding different spraying devices. The outlets are opened or closed by a positioning element such that one or several or all outlets are open or closed one after another and/or continuously. In order to better influence the course of the wash cycle and to obtain an optimal washing effect corresponding to the degree of dirtiness of the goods to be washed, the characteristics of the hydraulic assembly and the characteristics of the circulating pump are simultaneously or alternately changed by the movement reversal device.

18 Claims, 4 Drawing Sheets

U.S. PATENT DOCUMENTS

| | | | | |
|---|---|---|---|---|
| 6,601,593 | B1 | 8/2003 | Deiss et al. | |
| 2003/0168087 | A1 * | 9/2003 | Inui et al. | 134/57 D |

FOREIGN PATENT DOCUMENTS

| | | | |
|---|---|---|---|
| DE | 195 13 352 | A1 | 10/1996 |
| DE | 196 52 233 | * | 6/1998 |
| DE | 198 57 103 | A1 | 6/2000 |
| DE | 100 00 772 | A1 | 7/2000 |
| DE | 199 07 157 | A1 | 8/2000 |
| DE | 199 07 158 | A1 | 8/2000 |
| DE | 199 07 188 | A1 | 8/2000 |
| DE | 100 65 571 | A1 | 7/2002 |
| EP | 1 042 982 | A1 | 10/2000 |
| EP | 1 088 509 | A1 | 4/2001 |
| FR | 2431278 | * | 2/1980 |
| FR | 2713078 | * | 12/1994 |
| GB | 2001523 | * | 2/1979 |
| GB | 2290222 | * | 12/1995 |
| GB | 2290223 | * | 12/1995 |
| JP | 6-233736 | * | 6/1994 |
| WO | 00/33720 | | 6/2000 |

* cited by examiner

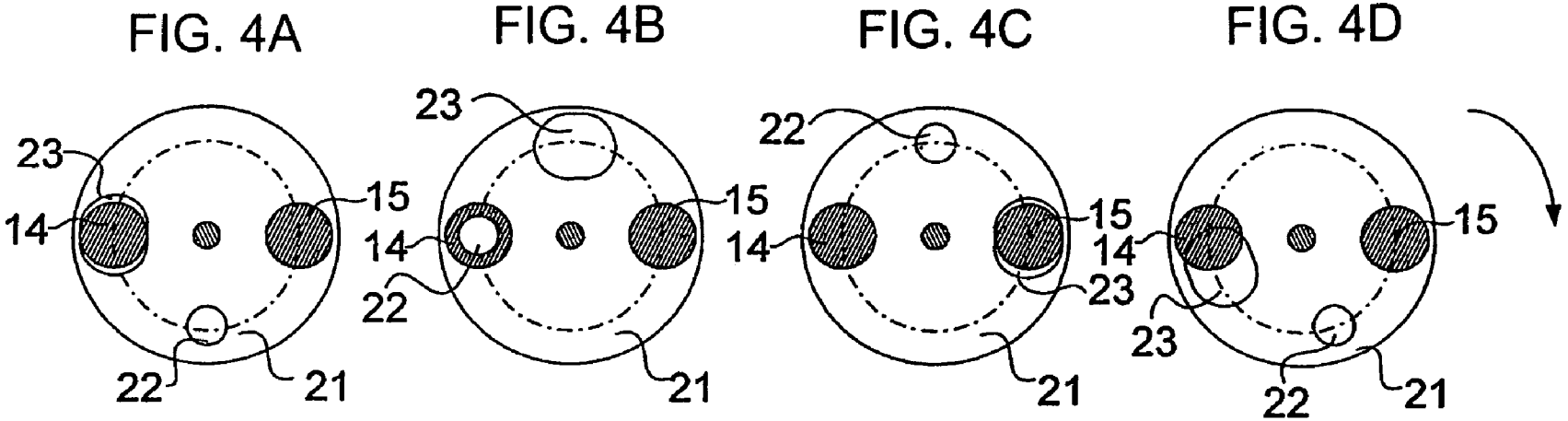
FIG. 4A
FIG. 4B
FIG. 4C
FIG. 4D
15
14
23
22
21
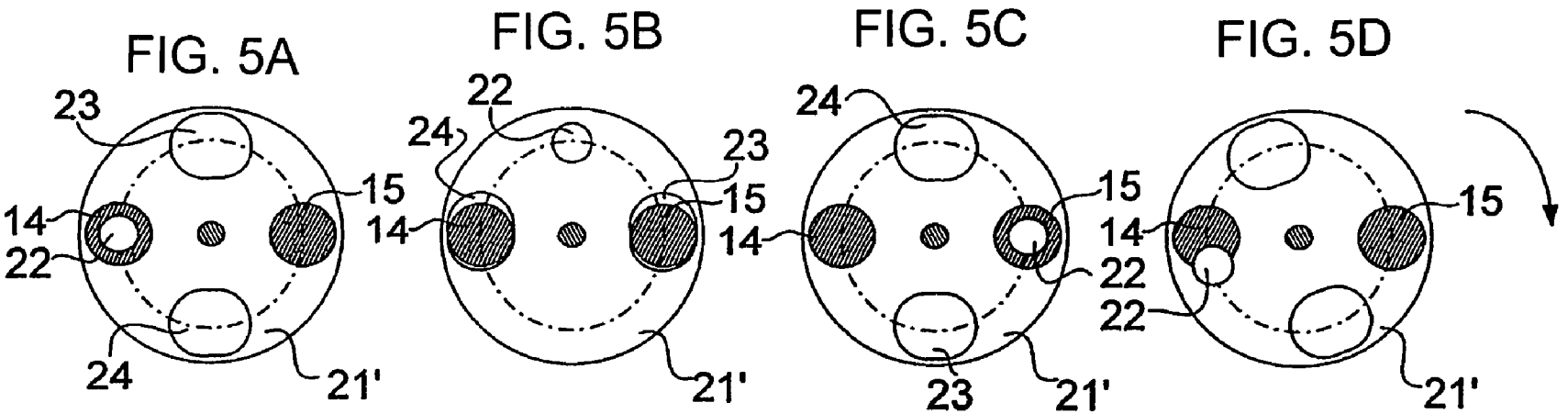
FIG. 5A
FIG. 5B
FIG. 5C
FIG. 5D
15
14
23
22
24
21'

MOVEMENT REVERSAL DEVICE, PARTICULARLY FOR A DISHWASHER

CROSS-REFERENCE TO RELATED APPLICATION

This application is a continuation, under 35 U.S.C. § 120, of copending international application No. PCT/EP02/13254, filed Nov. 25, 2002, which designated the United States; this application also claims the priority, under 35 U.S.C. § 119, of German patent application No. 101 63 184.7, filed Dec. 21, 2001; the prior applications are herewith incorporated by reference in their entirety.

BACKGROUND OF THE INVENTION

Field of the Invention

The present invention relates to a movement reversal device, in particular for a dishwashing machine with a washing receptacle having a hydraulic configuration with at least two spraying devices. The spraying devices supply items to be washed disposed in the washing receptacle with liquid conveyed by a circulating pump. The conveyed liquid flows through a movement reversal device, and the movement reversal device has at least two outlets for feeding the liquid to different spraying devices in each case, which can be opened or closed by a positioning element such that in each case either one of the outlets or a number of outlets or all outlets can be opened or closed one after another and/or continuously.

Published, Non-Prosecuted German Patent Application DE 198 57 103 A1, corresponding to U.S. Pat. No. 6,601,593, discloses a movement reversal device of the type initially described, in which the positioning element is a rotary slide valve disposed in a flow heater, which in reverse direction in each case has a closed area after an open area, between which there is an unfilled distance. The above-mentioned open area is a circular opening.

Controlling the rotary slide valve disclosed in Published, Non-Prosecuted German Patent Application DE 198 57 103 A1 can be managed for example with an actuating mechanism known from Published, Non-Prosecuted German Patent Application DE 100 65 571 A1, which contains a motor-driven cam plate connected solidly to the rotary slide valve.

Published, Non-Prosecuted German Patent Application DE 199 07 158 A1 reveals that the revolution speed of the circulating pump can be regulated. In Published, Non-Prosecuted German Patent Application DE 199 07 188 A1 it is suggested to avoid heightened noise when switching the spraying devices, to reduce the revolution speed of the circulating pump when changing the spraying devices, and whereby in the above-mentioned Published, Non-Prosecuted German Patent Application DE 198 57 103 A1 and also in Published, Non-Prosecuted German Patent Application DE 199 07 157 A1 it is specified to configure the revolution speed of the circulating pump when operating a lower spraying device higher than when operating an upper spraying device, to ensure full usage of the filled quantity of liquid.

The electronic regulating of the revolution speed of the circulating pump specifies only one aspect of the effect on the program sequence, e.g. in a dishwashing machine, namely a change in the characteristic pump curve and thus in the supply pressure to goods to be washed, e.g. items for cleaning, and the quantity of liquid, with which the goods to be cleaned, e.g. items for cleaning, are supplied.

SUMMARY OF THE INVENTION

It is accordingly an object of the invention to provide a movement reversal device that overcomes the above-mentioned disadvantages of the prior art devices of this general type, which improves the cleaning cycle, and thus optimizes the cleaning effect corresponding to the degree of dirtiness of the goods to be cleaned.

With the foregoing and other objects in view there is provided, in accordance with the invention, a combination of a dishwashing machine having a washing receptacle for receiving goods to be washed, a circulating pump for conveying a liquid and a hydraulic configuration with at least two spraying devices, with a movement reversal device through which the liquid flows. The movement reversal device contains a movement reversal device body having a positioning element and at least two outlets formed therein for supplying the liquid to different ones of the spraying devices. The two outlets are opened or closed by the positioning element, such that in each case either one of the two outlets or both of the two outlets are opened or closed alternately one after another and/or continuously, and a characteristic of the hydraulic configuration and a characteristic of the circulating pump are altered simultaneously or alternately.

The task is solved according to the present invention by the characteristic of the hydraulic configuration and the characteristic of the circulating pump being changed either simultaneously or alternately.

A combination of the influence of the characteristic on the one hand of the hydraulic configuration and on the other hand of the circulating pump enables substantially greater variability in the programming, e.g. of a dishwashing machine, and thus substantially greater variation options in the supply of the cleaning goods, with which a movement reversal device is created in a simple manner, with which the possibilities of an effect on the sequence of the washing cycle are improved and thus a cleaning effect corresponding to the degree of dirtiness of the goods to be washed is optimized.

According to a preferred feature of the invention the characteristic of the hydraulic configuration is altered by changing the through flow of the liquid through the movement reversal device and the characteristic of the circulating pump is altered by regulating the speed of the circulating pump, by which the combination according to the present invention of the influence of the characteristic on the one hand of the hydraulic configuration and on the other hand of the circulating pump in a simple manner is achieved.

According to a preferred embodiment of the invention the positioning element of the hydraulic configuration has at least one opening with a different cross-section compared to at least one other opening. Through at least a smaller opening it is possible to convey a lesser quantity of liquid to a desired spraying device, thus creating the simplest option for influencing the characteristic of the hydraulic configuration.

Advantageously the at least one opening with the different cross-section has a substantially smaller cross-section compared to the at least one other opening, further simplifying the possibility of influencing the characteristic of the hydraulic configuration.

In a particularly advantageous manner the opening with the substantially lesser cross-section compared to the at least one other opening serves to supply the liquid to an upper spraying device, such that the latter can be operated without dry running with the quantity of liquid available for circulating. The quantity of liquid, the so-called dead water quantity, found in the longer supply of liquid to the upper spraying device, is reduced in a simple manner, due to the opening assigned to the supply of liquid to an upper spraying device with the substantially lesser cross-section compared to the at least one other opening.

The positioning element is preferably a disc, which has at least one opening with the substantially lesser cross-section compared to the at least one other opening. Configuring the inventive movement reversal device as a disc is the simplest option for reversing the inventive movement reversal device.

The at least one larger opening appropriately acts substantially as the supply for liquid to a lower spraying device, but alternatively can also serve as the supply for liquid to the upper spraying device. Due to the opening assigned to the supply for liquid to the lower spraying device with the substantially larger cross-section compared to the at least one smaller opening the possibility of conveying substantially larger quantities of washing liquid is created in a simple manner. Using the at least one large opening alternatively for supply to the upper spraying device also the possibility for supplying substantially larger quantities of washing liquid to the upper spraying device also is achieved in a simple manner.

For the above-described application, in which all outlets of the inventive movement reversal device are opened alternately one after another and/or continuously, preferably two larger openings opposite one another on the disc serve as a simultaneous supply of liquid to a lower and an upper spraying device. By using a varying quantity of liquid for the different modes of the spraying device being only the upper spraying device, only the lower spraying device, or both spraying devices, the variability in the wash cycle control is thus increased.

Appropriately, closed areas of the positioning element, which rest sealed in the locked positions on the corresponding outlets, in each case have a revolving sealing edge, projecting up in the direction of the outlets. Also, according to a further preferred embodiment of the invention the smaller opening is enclosed by a sealing edge projecting up in the direction of the outlets. In a simple manner this measure guarantees a thorough sealing bearing on the corresponding outlets.

Alternatively the speed of the circulating pump is decreased or increased in predetermined part program segments of the washing cycle or throughout the entire washing cycle, by which the plurality of program types can be further boosted, and particularly good matching of the program sequence to the types of soiling of the items to be washed, e.g. the goods to be washed goods in a dishwashing machine, is achieved.

The movement reversal device is produced via the invention in a simple manner, with which the possibilities of an effect on the sequence of the washing program are improved, and thus a cleaning effect corresponding to the degree of dirtiness of the goods to be cleaned is optimized.

Other features which are considered as characteristic for the invention are set forth in the appended claims.

Although the invention is illustrated and described herein as embodied in a movement reversal device, particularly for a dishwasher, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 4A–4D are illustrations showing possible positions of a positioning element of the first embodiment of the movement reversal device;

FIGS. 5A–5D are illustrations showing possible positions of the positioning element of a second embodiment of the movement reversal device.

DESCRIPTION OF THE PREFERRED EMBODIMENTS

Figure 1:
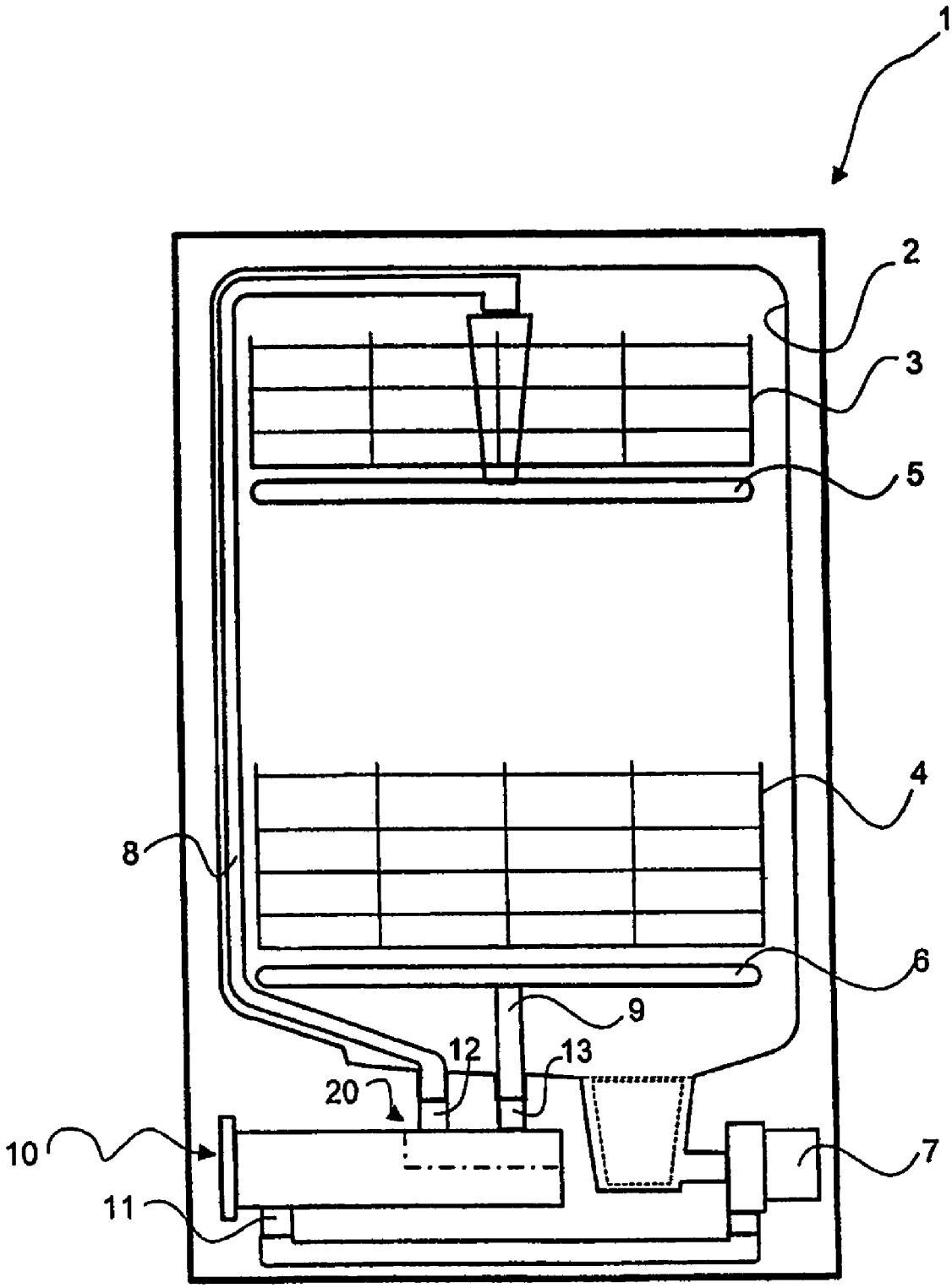
FIG. 1 is a schematic representation of a domestic dishwashing machine.
Figure 2:
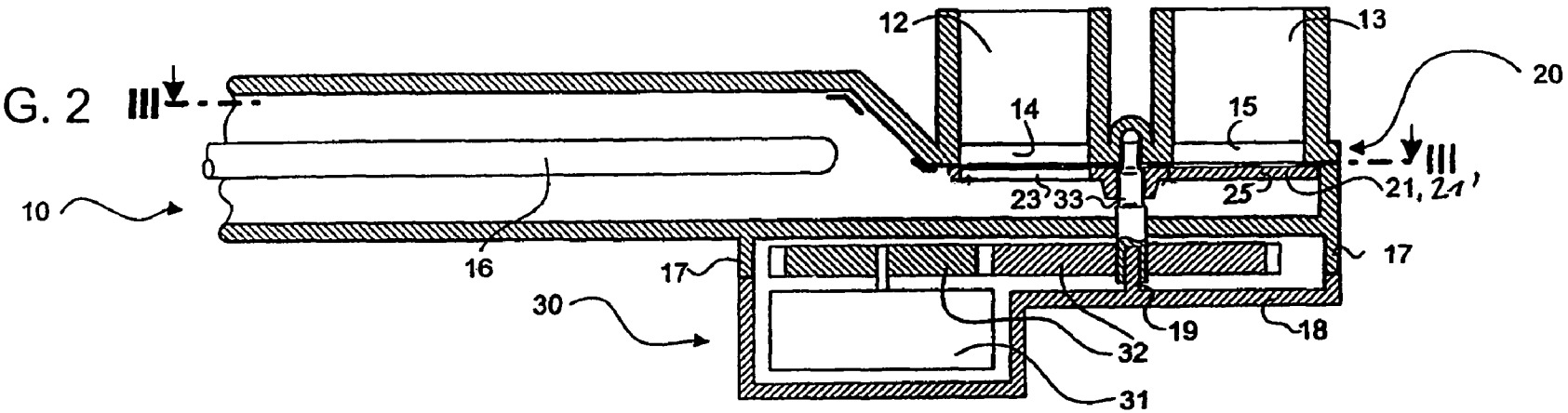
FIG. 2 is a diagrammatic, partial, side sectional view of a flow heater with a movement reversal device according to the invention.
Figure 3:
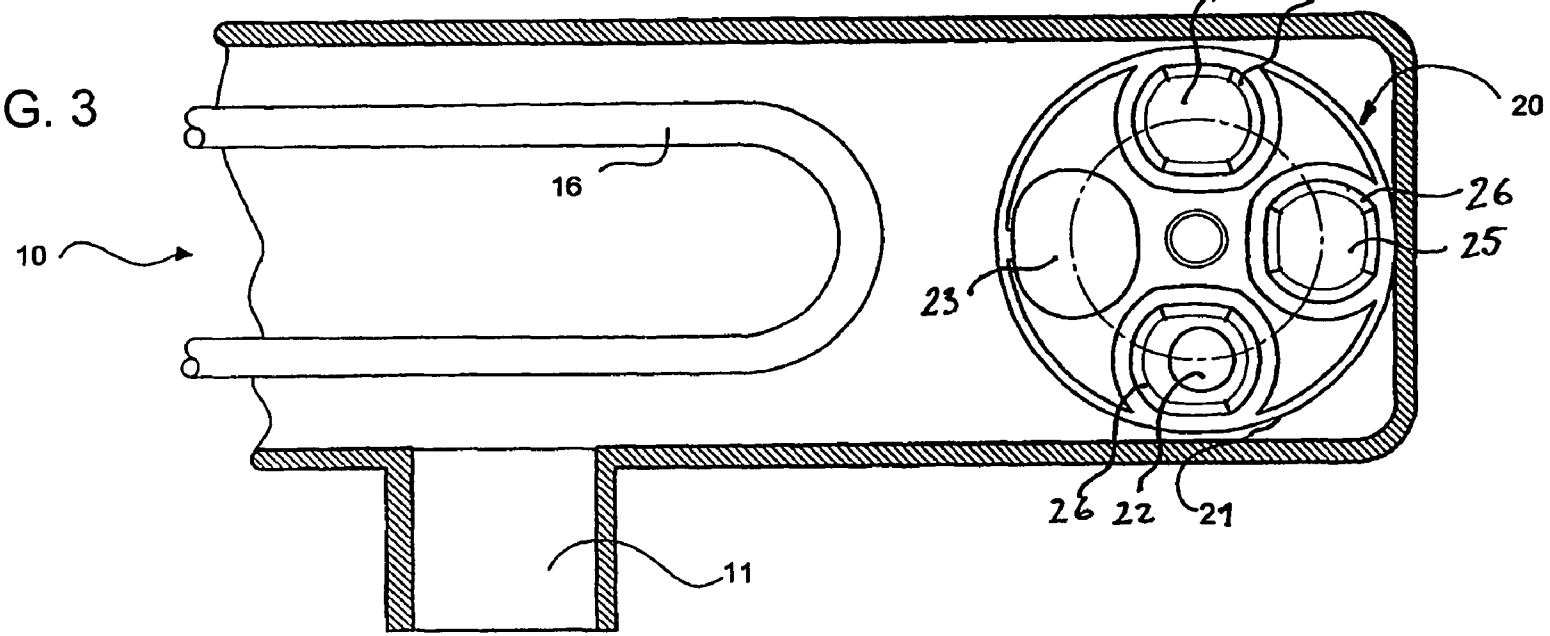
FIG. 3 is a diagrammatic, partial, top sectional view of the flow heater with a first embodiment of the inventive movement reversal device taken along the line III—III shown in FIG. 2.

Referring now to the figures of the drawing in detail and first, particularly, to FIG. 1 thereof, there is shown an inventive movement reversal device in an application for a domestic dishwashing machine 1. The domestic dishwashing machine 1, not described in greater detail here, has a washing receptacle 2, in which goods to be washed, e.g. dirty dishes and cutlery, are placed, usually into dish racks 3, 4. Provided in the dishwashing machine 1 is a hydraulic configuration, whereby, at least two spraying devices are disposed in the washing receptacle 2, in the illustrated embodiments two spraying devices 5, 6, which supply the goods to be washed disposed in the washing receptacle 2 with liquid. The liquid, usually called dishwashing liquid, is conveyed to the spraying devices 5, 6 in liquid supply lines 8, 9 by a circulating pump 7. Normally, the liquid conveyed in domestic dishwashing machines 1 is heated at least in a part program segment of a wash cycle, for which purpose the domestic dishwashing machine 1 in the illustrated embodiments has a flow heater 10. The liquid conveyed in the domestic dishwashing machine 1 is forwarded by the circulating pump 7 to a supply connection 11 of the flow heater 10 and through the flow heater 10. The flow heater 10 has at least two outlet connections, namely a number of outlet connections corresponding to the number of spraying devices or simultaneously operated groups of spraying devices, in the illustrated embodiments two outlet connections 12, 13. The liquid is conveyed via the above-mentioned liquid supply lines 8, 9 to the different spraying devices 5, 6 from the outlet connections 12, 13 of the flow heater 10. The heating rods required to heat the liquid in the flow heater 10 are designated by reference numeral 16 (FIG. 2).

The conveyed liquid flows through a movement reversal device 20, disposed in the illustrated embodiments in the flow heater 10, for which purpose the conveyed liquid is forwarded by the circulating pump 7 to the supply connection 11 of the flow heater 10, which is thus also the supply connection for the movement reversal device 20. The movement reversal device 20 has at least two outlets. In the illustrated embodiment the two outlet connections 12, 13 of the flow heater 10 are the outlets for the movement reversal device to supply the liquid in each case to the different spraying devices 5, 6. The outlet connections 12, 13 can be opened or substantially closed by a positioning element 21, 21' of the movement reversal device 20 disposed in the illustrated embodiments in the flow heater 10, in the direction of flow in front of the outlet connections 12, 13, such that in each case either one of the outlet connections 12, 13 or a number of outlet connections 12, 13 or all outlet connections 12, 13 are opened or substantially closed alternately one after another and/or continuously. For this, the positioning element 21, 21' of the movement reversal device 20, configured in the illustrated embodiments as a disc, is disposed in the direction of flow in front of each outlet connection 12, 13 of the upstream outlets 14, 15 of the flow heater 10. In the illustrated preferred embodiment according to FIGS. 3 and 4A–4D one of the outlets 14, 15 of the flow heater 10 can be closed off by the positioning element 21 in each case, and the two outlets 14, 15 can be opened or substantially closed either alternately one after another and/or continuously by the positioning element 21' in the illustrated second embodiment according to FIGS. 5A–5D.

According to the present invention the characteristic of the hydraulic configuration and the characteristic of the circulating pump 7 is altered at the same time or alternately, whereby the characteristic of the hydraulic configuration is altered by changing the through flow of the liquid through the movement reversal device 20 and the characteristic of the circulating pump 7 is altered by regulating the speed of the circulating pump 7.

The inventive change in the characteristic of the hydraulic configuration is first explained herein below.

For the inventive change in the characteristic of the hydraulic configuration the positioning element 21, 21' has at least one opening 22 with a different cross-section compared to the cross-section at least of another opening 23. The at least one opening 22 with the different cross-section has, compared to the cross-section of the at least one other opening 23, a substantially lesser cross-section. A possibility is created by the smaller opening 22 conveying a lesser quantity of liquid to a desired spraying device 5, 6, and a possibility is created with the larger opening 23, 24 conveying a larger quantity of liquid to a desired spraying device 5, 6, by which the simplest possibility for influencing the characteristic of the hydraulic configuration is created in a simple manner.

In the illustrated embodiments the opening 22 with the substantially lesser cross-section, hereinafter referred to as the smaller opening 22, compared to the at least one further opening 23, hereinafter referred to as larger opening 23, serves to supply the liquid to the upper spraying device 5.

Due to the opening 22 with the substantially lesser cross-section compared to the at least one further opening 23, assigned to the supply of liquid to the upper spraying device 5, the so-called dead water quantity is reduced on account of the quantity of liquid in the longer supply of liquid to the upper spraying device 5.

The openings 22, 23 are disposed in the illustrated embodiments at a right angle to one another on a circle with the same radius indicated in FIGS. 3, 4A–4D and 5A–5D by dashed lines. The configuration of the openings on the same radius at a right angle (90 degree offset) to one another creates a very simple possibility of controlling the movement reversal device 20. In the illustrated embodiments the at least one larger opening 23 serves to supply the liquid to the lower spraying device 6, although with particular program cycles the latter can also alternatively serve to supply the liquid to the upper spraying device 5. In using the at least one large opening 23 alternately also for supplying the upper spraying device 5 the possibility is created to supply substantially larger quantities of washing liquid also to the upper spraying device 5 in a simple manner.

In the further embodiment illustrated in FIGS. 5A–5D the two opposite, larger openings 23, 24 on the positioning element 21' (e.g. the disc), act simultaneously for supplying the liquid to the lower spraying device 6 and to the upper spraying device 5.

The closed regions of the positioning element 21, 21' (e.g. the disc) which in the locked positions rest tight on the corresponding outlets 14, 15, are designated by 25 and in each case have a revolving sealing edge 26 projecting up in the direction of the outlets 14, 15. Also, the smaller opening 22 is enclosed by such a sealing edge 26 (see FIG. 3). This measure guarantees a thorough sealing bearing on the corresponding outlets 14, 15 in a simple manner.

A drive unit 30 is a motor 31, e.g. an electromotor, with gears 32, illustrated only schematically in FIG. 2, e.g. a toothed gearing. The control element 21 is connected to the gears 32 by a shaft 33, which is guided in a housing of the flow heater 10. The motor 30 and the gears 32 are protected by a cover 18 sitting on a folded-up edge 17 of the flow heater 10. The cover 18 also has bearings for the gears 32, of which only one folded-up bearing journal 19 is illustrated, as a bearing for the shaft 33.

Herein below the function of the inventive movement reversal device 20 is explained for both illustrated embodiments.

First comes the description of the function of the first (e.g. preferred) embodiment of the inventive movement reversal device 20 with the positioning element 21.

With the positioning element 21 of the preferred embodiment of the inventive movement reversal device 20 according to FIGS. 3 and 4A–4D in each case either one of the outlets 14, 15 is opened alternately one after another and/or continuously, or substantially held closed.

If the aim is to supply the spraying devices 5, 6 with a reduced quantity of liquid to the upper spraying device 5, then the motor 31 of the drive device 30 is connected to the supply voltage by a program control device of the domestic dishwashing machine 1, not shown in greater detail here, and the positioning element 21 begins to turn clockwise, as indicated by an arrow next to FIG. 4D. One the closed areas 25 of the positioning element 21 is turned until it sits tight on the outlet 15 and the smaller opening 22 lies over the outlet 14. This corresponds to the position of the positioning element 21 in FIG. 4B. In the process the supply of liquid flowing through the flow heater 10 in this case to the lower spraying device 6 is interrupted and the supply to the upper spraying device 5 is opened on account of the smaller opening 22 with less liquid throughput. The movement reversal device 20 remains in this position for an effective period provided in the program cycle, approximately one minute in the illustrated embodiment, whereby the location of the positioning element 21 is fixed by a sensory mechanism, not described in greater detail here, e.g. the actuator mechanism described in Published, Non-Prosecuted German Patent Application DE 100 65 571 A1 which is hereby incorporated herein, the motor 31 is switched off by the program control device for a preset duration, so that the respective location of the positioning element 21 is maintained for this duration.

With selective supplying of the spraying devices 5, 6 the motor 31 turns further, by which one of the closed areas 25 sits tight on the outlet 14 after a revolution of the positioning element 21 through 90° in the embodiment and the larger opening 23 lies over the outlet 15. This corresponds to the position of the positioning element 21 in FIG. 4C. Supply to the upper spraying device 5 is now interrupted and supply is opened to the lower spraying device 6 with a larger liquid throughput. In this position the movement reversal device 20 now remains for an effective period provided in the program cycle, approximately one minute in the illustrated embodiment. However, subsequent continuous further rotation of the motor 31 to the position in FIG. 4B, in the illustrated embodiment over 270°, quickly results in opening of the outlet 15 by the smaller opening 22 on account of the rapid rotation of the positioning element 21, and then in opening of the outlet 14 by the larger opening 23 (see FIG. 4D and then FIG. 4A), until one of the closed areas 25 rests on the outlet 15 and the smaller bore 22 on the outlet 14, with the procedure being repeated as above. As described initially, selective charging of the spraying devices 5, 6 is used especially to save water, whereby according to the present invention the smaller opening 22 of the positioning element 21 of the inventive movement reversal device 20 prevents intake of air with unpleasant and unwanted noise from the circulating pump 7 by a lesser liquid throughput to the upper spraying device 4, such that empty suction of the suction chamber of the circulating pump 7 does not occur, and thus a decrease in the revolution speed of the circulating pump 7 is not necessary, as in the prior art.

But now if selective charging of the spraying devices 5, 6 with an unchecked liquid supply to the upper spraying device 5 is wanted, the positioning element 21 is turned until one of the closed areas 25 of the positioning element 21 sits tight on the outlet 15, and the larger opening 23 lies over the outlet 14. This corresponds to the position of the positioning element 21 shown in FIG. 4A. Accordingly the charging of the liquid flowing through the flow heater 10 in this case to the lower spraying device 6 is interrupted and the supply to the upper spraying device 5 is opened due to the larger opening 23 with an unreduced liquid throughput. The movement reversal device 20 remains in this position for an effective period provided in the program sequence, approximately one minute in the illustrated embodiment. With selective charging of the spraying devices 5, 6 the motor 31 then rotates further, but at the same time, on account of the rapid revolution of the positioning element 21, this quickly results in a further opening of the outlet 14 by the smaller opening 22 (see FIG. 4B). After rotation of the positioning element 21 through 180° in the embodiment one of the closed areas 25 sits tight on the outlet 14, and the larger opening 23 lies over the outlet 15. This corresponds to the position of the positioning element 21 in FIG. 4C. Accordingly, supply to the upper spraying device 5 is interrupted and supply to the lower spraying device 6 with larger liquid throughput is opened. The movement reversal device 20 now remains in this position for an effective period provided in the program sequence, approximately one minute in the illustrated embodiment. With subsequent continuous further rotation of the motor 31 to the position in FIG. 4A, in the illustrated embodiment again through 180°, until one of the closed areas 25 again bears on the outlet 15 and the larger bore 23 lies on the outlet 14, and the procedure continues as above.

But if continuous opening only of the liquid supply line 8 to the upper spraying device 5 with an undiminished quantity of liquid is wanted, a so-called complete upper rack washing, then the above described sensory mechanism is employed to run the motor 31 only until the larger opening 23 of the positioning element 21 has reached the outlet 14 for the outlet connection 12 to the liquid supply line 8 to the upper spraying device 5, see FIG. 4A, and then to maintain this position throughout the entire wash cycle, because the motor 31 is no longer being run.

If a continuous opening only of the liquid supply line 8 to the upper spraying device 5 is wanted, though with a reduced quantity of liquid, a so-called choked upper rack washing, then the above described sensory mechanism is employed to run motor 31 only until the larger opening 23 of the positioning element 21 has only partially opened the outlet 14 for the outlet connection 12 to the liquid supply line 8 to the upper spraying device 5, see FIG. 4D, and then to maintain this position throughout the entire wash cycle, because the motor 31 is no longer being run.

But if continuous opening only of the liquid supply line 8 to the upper spraying device 5 is wanted, though with the reduced quantity of liquid during selective operation, so-called strongly choked upper rack washing, then the above described sensory mechanism is employed to run the motor 31 only until the smaller opening 22 of the positioning element 21 has opened the outlet 14 for the outlet connection 12 to the liquid supply 8 to the upper spraying device 5, see FIG. 4B, and then to maintain this position throughout the entire wash cycle, because the motor 31 is no longer being run.

Of course, it is also conceivable to alternatively carry out continuous opening only of the liquid supply line 9 to the lower spraying device 6. With the above described sensory mechanism the motor 31 would run only until the larger opening 23 of the positioning element 21 has reached the outlet 15 for the outlet connection 13 to the liquid supply line 9 to the lower spraying device 6, see FIG. 4C, and then, because the motor 31 would no longer be run, would maintain this position throughout the complete wash cycle.

Simultaneous operation of both spraying devices 5, 6 without exchange between them by simultaneous supply of liquid, a so-called dual rack washing, is not provided with this first embodiment of the inventive movement reversal device 20.

The description of the function of the second embodiment of the inventive movement reversal device 20 with the positioning element 21' now follows.

With the positioning element 21' of the second embodiment of the inventive movement reversal device 20 according to FIGS. 5A–5D, in each case, either one of the outlets 14, 15 or both outlets 14, 15 is opened or held substantially closed alternately one after another and/or continuously.

If selective charging of the spraying devices 5, 6 is wanted, then the connection of the motor 31 of the drive mechanism 30 to the supply voltage by a program control device of the domestic dishwashing machine 1, not explained in greater detail here, is made, and the positioning element 21' begins to revolve clockwise, as indicated by an arrow next to FIG. 5D. Thereby one of the closed areas 25 of the positioning element 21' is rotated until it is sitting tight on the outlet 15, and the smaller opening 22 lies over the outlet 14. This corresponds to the position of the positioning element 21' in FIG. 5A. Thus the supply of liquid flowing through the flow heater 10 liquid in this case to the lower spraying device 6 is interrupted, and the supply to the upper spraying device 5 is opened. The movement reversal device 20 remains in this position, for approximately one minute in the illustrated embodiment, whereby the location of the positioning element 21 is fixed by a sensory mechanism, not described in greater detail here, and the motor 31 is switched off by the program control device for a preset duration, so that each location of the positioning element 21' is kept throughout this duration.

But subsequent continuous further rotation of the motor 31 to the position in FIG. 5C, in the illustrated embodiment through 180°, in which one of the closed areas 25 sits tight on the outlet 14 and the smaller opening 22 lies over the outlet 15, temporarily and quickly results in opening of both outlets 14, 15 by the larger openings 23, 24 (see FIG. 5B) due to the rapid rotation of the positioning element 21' (past the position in FIG. 5B to the position in FIG. 5C). Supply to the upper spraying device 5 is interrupted in the position of the positioning element 21' according to FIG. 5C, and supply to the lower spraying device 6 is opened. The movement reversal device 20 remains in this position, again for approximately one minute in the illustrated embodiment.

But subsequent further rotation of the motor 31 to the position according to FIG. 5A, in the illustrated embodiment through 180°, in which one of the closed areas 25 sits tight on the outlet 15 and the smaller opening 22 lies over the outlet 14, temporarily and quickly results in opening of both outlets 14, 15 by the larger openings 23, 24 due to the rapid rotation of the positioning element 21'. Supply to the lower spraying device 6 is interrupted in the position of the positioning element 21' according to FIG. 5A, and supply to the upper spraying device 5 is opened. The movement reversal device 20 remains in this position, again for approximately one minute in the illustrated embodiment, and then the procedure is repeated, as above.

But if continuous opening only of the liquid supply line 8 to the upper spraying device 5 is wanted, a so-called choked upper rack washing, then the above described sensory mechanism is employed to run the motor 31 only until the smaller opening 22 of the positioning element 21' has reached the outlet 14 for the outlet connection 12 to the liquid supply 8 to the upper spraying device 5, see FIG. 5A, and then to maintain this position throughout the entire wash cycle, because the motor 31 is no longer being run.

If continuous opening only of the liquid supply line 8 to the upper spraying device 5 is wanted, though with reduced quantity of liquid, a so-called strongly choked upper rack washing, then the above described sensory mechanism is employed to run the motor 31 only until the smaller opening 22 of the positioning element 21' has only partially opened outlet 14 for the outlet connection 12 to the liquid supply 8 to the upper spraying device 5, see FIG. 5D, and then to maintain this position throughout the entire wash cycle, because the motor 31 is no longer being run.

The so-called complete upper rack washing is not provided in the second embodiment.

If, alternatively, continuous opening only of the liquid supply line 9 to the lower spraying device 6 were now wanted, then the above described sensory mechanism would be used to run the motor 31 only until the smaller opening 22 of the positioning element 21' has reached the outlet 15 for the outlet connection 13 to the liquid supply line 9 to the lower spraying device 6, see FIG. 5C, and then to maintain this position throughout the entire wash cycle, because the motor 31 is no longer being run.

If uninterrupted operation of both spraying devices 5, 6 is wanted in the second embodiment of the inventive movement reversal device 20, the position of the openings 23 and 24 on the positioning element 21' at both outlets 14, 15 can again be fixed by the above described sensory mechanism (see FIG. 5B) and this position maintained throughout the entire wash cycle, as the motor 31 is no longer being operated. The filling quantity with washing liquid is increased correspondingly.

The inventive change in the characteristic of the circulating pump 7 will now be explained herein below.

According to the present invention the characteristic of the circulating pump 7 is altered by regulating the speed of the circulating pump 7. Alternatively, the speed of the circulating pump 7 is reduced or raised in predetermined part program segments of the washing cycle or throughout the entire washing cycle, by which the plurality of program types can be further boosted, and particularly good matching of the program sequence to the types of soiling of the items to be washed, e.g. the washing goods in a dishwashing machine, is achieved.

Figure 6:
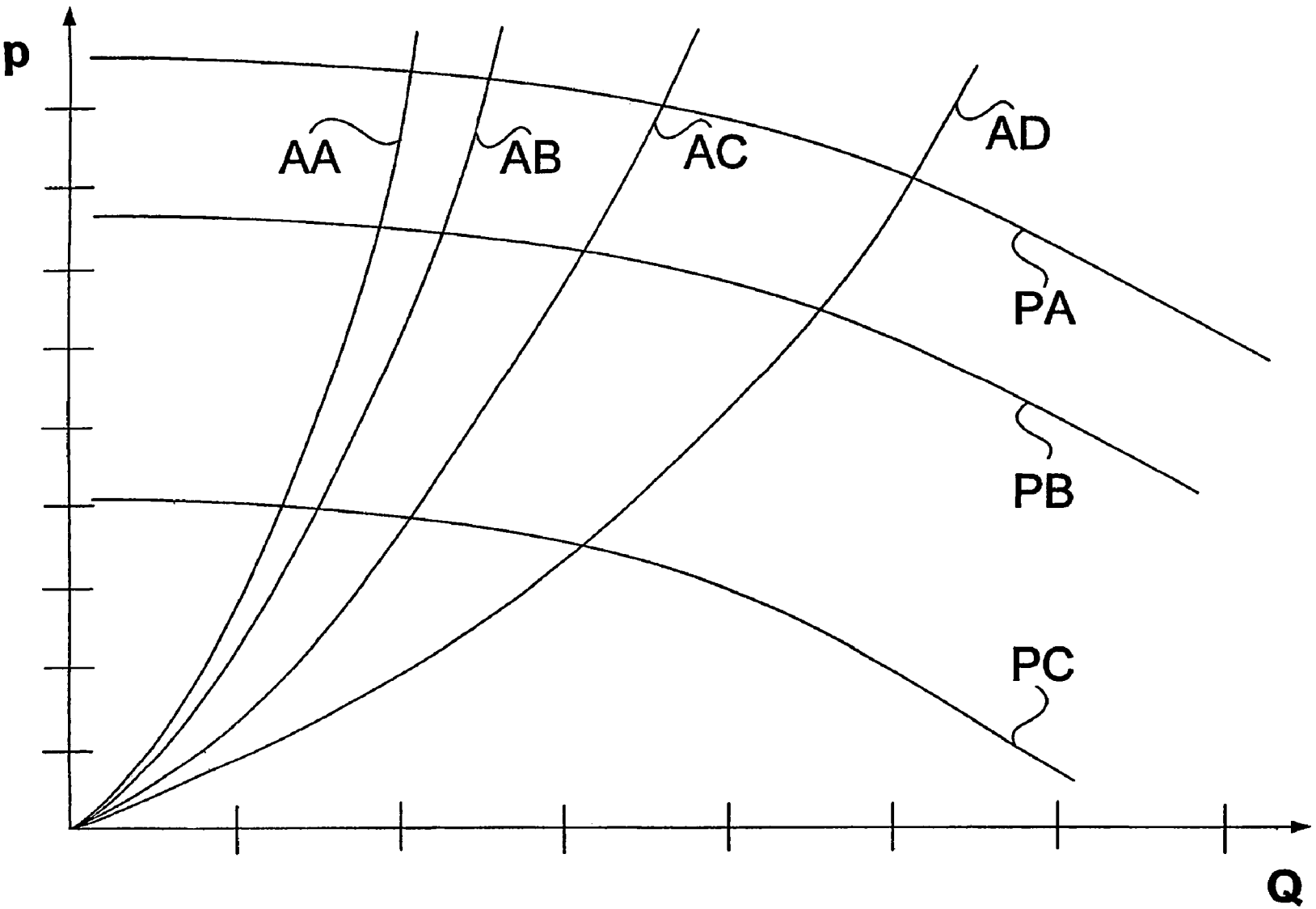
FIG. 6 is a graph showing a pressure and feed volume diagram with possible pump and equipment characteristic curves.

In FIG. 6 a pressure feed volume diagram with possible pump and characteristic equipment curves is shown, in which the pressure p is scaled on the Y-axis and the feed volume Q is scaled on the X-axis.

Reducing the speed of the circulating pump 7 has the effect of lowering the pressure generated by the circulating pump and thus also of the conveyed quantity of liquid. Conversely, the effect of raising the speed of the circulating pump 7 is an increase in the pressure generated by the circulating pump and thus also of the conveyed quantity of liquid. Basically, as shown in FIG. 6, the characteristic pump curve, see characteristic pump curve PB, is moved parallel upwards with an increase in the speed, see characteristic pump curve PA, and is moved parallel downwards with a drop in the speed, see characteristic pump curve PC. As mentioned at the outset on the prior art, to prevent increased noise levels when exchanging the spraying devices, the speed is reduced or e.g. the speed of the circulating pump during operation of the lower spraying device is set higher than during operation of the upper spraying device, to ensure full usage of the filled quantity of liquid.

The effect of the inventive combination of both the previously described alteration measures is now discussed hereinafter.

According to the present invention the characteristic of the hydraulic configuration and the characteristic of the circulating pump 7 is changed at the same time or alternately.

Apart from the examples for the position of the characteristic pump curves PA, PB, PC the characteristic equipment curves AA, AB, AC, AD for the above mentioned different settings of the movement reversal device 20, and thus of the changed characteristic of the hydraulic configuration, are evident in FIG. 6. The characteristic equipment curve AA is the characteristic equipment curve for setting the positioning element 21 in FIG. 4B and that of the positioning element 21' in FIG. 5A, in which the supply of liquid flowing through the flow heater 10 to the lower spraying device 6 is interrupted and the supply to the upper spraying device 5 is opened on account of the smaller opening 22 with the lesser liquid throughput. The characteristic equipment curve AB is the characteristic equipment curve for setting the positioning element 21 in FIG. 4C, in which the supply to the upper spraying device 5 is interrupted, and the supply to the lower spraying device 6 with the greater liquid throughput is opened. The characteristic equipment curve AC is the characteristic equipment curve for setting the positioning element 21 in FIG. 4A, in which the supply of the liquid flowing through the flow heater 10, in this case to the lower spraying device 6, is interrupted and the supply to the upper spraying device 5 is opened on account the larger opening 23 with an unreduced liquid throughput. The characteristic equipment curve AD is the characteristic equipment curve for setting the positioning element 21' in FIG. 5B, in which the uninterrupted operation of both spraying devices 5, 6 is set and both outputs 14, 15 are opened with unreduced liquid throughput.

As is now evident from FIG. 6 at the twelve points of intersection of the characteristic pump curves PA, PB, PC with the characteristic equipment curves AA, AB, AC, AD, which serve merely as examples, the widest range of working points with the widest range of pressure and liquid conveying quantities values are set for the basically endless possible combinations, thus allowing virtually unlimited possible variations in supplying the goods to be washed. With program cycles, which can be adjusted either by the user corresponding to his estimation of the degree of dirtiness of the goods to be washed or by a suitable sensory mechanism of the domestic dishwashing machine 1, and which then contain corresponding working points, the program sequences match the degree of dirtiness of the goods to be washed substantially more precisely.

In FIG. 6 the use of only one pump type running at different speeds is shown via a few examples. The variation possibilities are naturally increased further still by using different pumps with different characteristic pump curves.

The energy and water consumption is optimized by optimal matching of the pressure and liquid conveying quantities values.

With the invention a movement reversal device is created in a simple manner, with which the possibilities of an effect on the sequence of the washing program are improved, and thus a cleaning effect corresponding to the degree of dirtiness of the goods to be washed is optimized.

We claim:

1. In combination with a dishwashing machine having a washing receptacle for receiving goods to be washed, a circulating pump for conveying a liquid and a hydraulic configuration with at least two spraying devices, a movement reversal device through which the liquid flows, the movement reversal device comprising:

a movement reversal device body having a positioning element and at least two outlets formed therein for supplying the liquid to different ones of the spraying devices, said two outlets being opened or closed by said positioning element, such that in each case either one of said two outlets or both of said two outlets being opened or closed alternately one after another and/or continuously, and a characteristic of the hydraulic configuration and a characteristic of the circulating pump being altered simultaneously or alternately, wherein the characteristic of the hydraulic configuration is altered by changing a through flow of the liquid through said movement reversal device body and the characteristic of the circulating pump is altered by regulating a speed of the circulating pump.

2. The movement reversal device according to claim 1, wherein said positioning element has at least two openings formed therein including a first opening and a second opening, said first opening having a different cross-section compared to a cross-section of said second opening.

3. The movement reversal device according to claim 2, wherein said cross-section of said first opening is smaller than said cross-section of said second opening.

4. The movement reversal device according to claim 3, wherein said first opening supplies the liquid to one of the spraying devices being an upper spraying device.

5. The movement reversal device according to claim 1, wherein said positioning element is a disc having at least two openings formed therein including a first opening and at least one second opening, said first opening having a smaller cross-section than said second opening.

6. The movement reversal device according to claim 5, wherein said second opening having a larger cross-section serves substantially to supply the liquid to one of the spraying devices being a lower spraying device, but alternatively can also serve to supply the liquid to another of the spraying devices being an upper spraying device as compared to the lower spraying device.

7. The movement reversal device according to claim 6, wherein said second opening is one of two second openings each having a larger cross section than said first opening, said second openings opposing one another on said disc and simultaneously supply the liquid to the upper spraying device and the lower spraying device.

8. The movement reversal device according to claim 1, wherein said positioning element has closed areas, which sit tight on said outlets in a locked position, each of said closed areas having a revolving sealing edge projecting up in a direction of said outlets.

9. The movement reversal device according to claim 8, wherein said positioning element has a further sealing edge surrounding said first opening and projecting up in a direction of said outlets.

10. The movement reversal device according to claim 1, wherein a speed of the circulating pump is lowered or raised in predetermined partial program segments of a washing cycle.

11. The movement reversal device according to claim 1, wherein a speed of the circulating pump is lowered or raised by a program sequence.

12. The movement reversal device according to claim 1, wherein said positioning element has, arranged in a clockwise progression, a first opening, a first closed area having a revolving sealing edge projecting in a direction of said outlets and operable to sit tight on a respective one of said outlets in a locked position, a second opening, and a second closed area having a revolving sealing edge projecting in a direction of said outlets and operable to sit tight on a respective one of said outlets in a locked position, said first opening having a smaller cross-section than said second opening.

13. The movement reversal device according to claim 1, wherein said positioning element has, arranged in a clockwise progression, a first opening, a first closed area having a revolving sealing edge projecting in a direction of said outlets and operable to sit tight on a respective one of said outlets in a locked position, a second opening, and a second closed area having a revolving sealing edge projecting in a direction of said outlets and operable to sit tight on a respective one of said outlets in a locked position, said positioning element being movable to selectively position said first opening over a respective one of said two outlets during a given period during which the liquid flows via said first opening into said respective outlet and said positioning element being movable to selectively position said second opening over said same respective outlet during another given period during which the liquid flows via said second opening into said respective outlet, said first opening having a different cross-section compared to a cross-section of said second opening such that said first opening has a lesser liquid throughput when positioned over said respective outlet as compared to said second opening when said second opening is positioned over said respective outlet.

14. The movement reversal device according to claim 1, wherein said positioning element has at least two openings formed therein including a first opening and a second opening, said positioning element being movable to selectively position said first opening over a respective one of said two outlets during a given period during which the liquid flows via said first opening into said respective outlet and said positioning element being movable to selectively position said second opening over said same respective outlet during another given period during which the liquid flows via said second opening into said respective outlet, said first opening having a different cross-section compared to a cross-section of said second opening such that said first opening has a lesser liquid throughput when positioned over said respective outlet as compared to said second opening when said second opening is positioned over said respective outlet.

15. A dishwashing machine, comprising:

a washing receptacle for receiving goods to be washed;

a circulating pump for conveying a liquid;

a hydraulic configuration with at least two spraying devices; and a movement reversal device through which the liquid flows, said movement reversal device fluidically connected to said hydraulic configuration and receiving the liquid from the circulating pump, said movement reversal device having a positioning element and at least two outlets formed therein for supplying the liquid to different ones of said spraying devices, said two outlets being opened or closed by said positioning element, such that in each case either one of said two outlets or both of said outlets being opened or closed alternately one after another and/or continuously, and a characteristic of said hydraulic configuration and a characteristic of said circulating pump being altered simultaneously or alternately, wherein the characteristic of the hydraulic configuration is altered by changing a through flow of the liquid through said movement reversal device body and the characteristic of the circulating pump is altered by regulating a speed of the circulating pump.

16. The dishwashing machine according to claim 15, wherein said positioning element has at least two openings formed therein including a first opening and a second opening, said first opening having a different cross-section compared to a cross-section of said second opening.

17. The dishwashing machine according to claim 15, wherein said positioning element has, arranged in a clockwise progression, a first opening, a first closed area having a revolving sealing edge projecting in a direction of said outlets and operable to sit tight on a respective one of said outlets in a locked position, a second opening, and a second closed area having a revolving sealing edge projecting in a direction of said outlets and operable to sit tight on a respective one of said outlets in a locked position, said first opening having a smaller cross-section than said second opening.

18. The dishwashing machine according to claim 15, wherein said positioning element has, arranged in a clockwise progression, a first opening, a first closed area having a revolving sealing edge projecting in a direction of said outlets and operable to sit tight on a respective one of said outlets in a locked position, a second opening, and a second closed area having a revolving sealing edge projecting in a direction of said outlets and operable to sit tight on a respective one of said outlets in a locked position, said positioning element being movable to selectively position said first opening over a respective one of said two outlets during a given period during which the liquid flows via said first opening into said respective outlet and said positioning element being movable to selectively position said second opening over said same respective outlet during another given period during which the liquid flows via said second opening into said respective outlet, said first opening having a different cross-section compared to a cross-section of said second opening such that said first opening has a lesser liquid throughput when positioned over said respective outlet as compared to said second opening when said second opening is positioned over said respective outlet.

* * * * *